United States Patent [19]

Bowyer

[11] 4,433,725

[45] Feb. 28, 1984

[54] ADJUSTABLE SPACER WITH ROTATIONAL LOCK

[75] Inventor: Michael L. Bowyer, Aberdeen, Scotland

[73] Assignee: Baker International Corporation, Orange, Calif.

[21] Appl. No.: 307,908

[22] Filed: Oct. 2, 1981

[51] Int. Cl.[3] ..... E21B 17/07

[52] U.S. Cl. ..... 166/65 R; 166/242; 166/381; 285/32; 285/302; 285/86

[58] Field of Search ..... 285/32, 302, 86; 166/65 R, 237, 242, 380, 381; 175/321

[56] References Cited

U.S. PATENT DOCUMENTS

| | | | |
|---|---|---|---|
| 3,170,520 | 2/1965 | Arutunoff | 166/106 |
| 3,321,018 | 5/1967 | McGill | 166/237 |
| 3,442,541 | 5/1969 | Metz | 285/86 |
| 4,258,792 | 3/1981 | Restarick | 166/315 |

*Primary Examiner*—William F. Pate, III
*Assistant Examiner*—Hoang C. Dang
*Attorney, Agent, or Firm*—Norvell & Associates

[57] ABSTRACT

A spacing apparatus for tubing conduit in a subterranean well, normally for use with an electric component with a longitudinally extending external electrical cable, permits irrotational adjustment of the length of the tubing conduit. The spacing apparatus comprises telescoping members which are keyed to prevent rotation therebetween. A threaded member, longitudinally fixed relative to one longitudinal member, normally engages threads extending substantially along the entire length of the other telescoping member. Movement of a retaining sleeve permits disengagement of the threaded segments which ratchet along the threads during telescoping movement. The length of the conduit can thus be irrotationally adjusted to remove slack from the electrical cable.

1 Claim, 6 Drawing Figures

ADJUSTABLE SPACER WITH ROTATIONAL LOCK

BACKGROUND OF THE INVENTION

1. Field of the Invention

This invention relates to the adjustment of the length of an oil well tubular completion string, especially where an electrical component, such as an electric submersible pump, is employed as a component in a tubing string.

2. DESCRIPTION OF THE PRIOR ART

Where an electric submersible pump is employed on the bottom of a tubing string in an oil well, it is necessary to extend an electrical cable from the surface of the well to the submersible pump. This requires the cable to be attached to a conventional packer, or other means such as a bridge plug, for isolating the tubing casing annulus thereabove from that below and from the production zone, engaging both the tubing string and the outer oil well casing at some point between the surface of the well and the submersible pump as the electrical cable must pass through the packer.

One of the problems encountered in the use of electric submersible pumps is that the pump will vibrate during operation and this vibration can cause the electrical cable, due to the amount of slack in the cable, to prematurely fail. By removing any slack in the electric cable between the location of the packer and the electric pump, the operating life of the cable and, therefore, the entire submersible pump tubing string can be extended. One means of removing the slack in the cable extending between the packer and the submersible pump is to employ some means to space out or stretch out the tubing extending between the packer and the pump. Conventional spacing elements generally require rotation in order to lengthen, or shorten, the tubing string between integral components in an oil well completion. Since the electric cable is carried on the exterior of the tubing string, these conventional rotational spacers would not provide an effective means of elongating the tubing string between a packer and a pump.

SUMMARY OF THE INVENTION

A spacing apparatus for adjusting the length of a tubular conduit in a subterranean well without relative rotation between the upper and lower portions of the conduit comprises inner and outer telescoping members. The telescoping members are prevented from rotation by means, such as a key, extending into aligned slots in each telescoping member. Longitudinal threads extend along one of the telescoping members, preferably along the outer surface of the inner telescoping member. One or more threaded segments engaging these longitudinally extending threads is relatively longitudinally fixed to the other telescoping member. A retaining member, such as a sleeve, normally retains the threaded segments in engagement with these longitudinal threads but, alternatively, permits the segments to move radially away from the longitudinal threads to permit relative longitudinal movement between the two telescoping members.

DESCRIPTION OF THE PREFERRED EMBODIMENT

Figure 1:
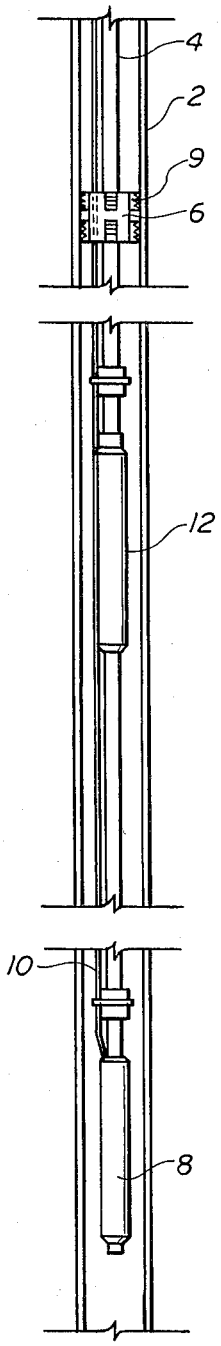
FIG. 1 is a schematic view illustrating a tubing string employing a conventional packer and a spacing element above a conventional electric submersible pump.

FIG. 1 is a schematic illustration showing a tubing string 4 in an oil well casing 2. The tubing string comprises a conventional packer 6 which has expanding anchoring slips for engaging the casing 2, thus affixing the tubing to the casing through the packer. An electric submersible pump 8, of conventional design, is shown at the bottom of the tubing string 4 below conventional packer 6. An electric cable 10 extends from the surface of the well and is attached along the exterior of tubing string 4. In this schematic representation the cable is shown extending through the body of packer 6, thus allowing packing elements to engage the casing and provide appropriate sealing integrity within the annulus between casing 2 and tubing string 4 and the slips 9 to engage the casing.

A space-out section, spacer member, or spacing apparatus 12, is shown immediately below the packer 6. This spacing apparatus 12 permits alteration of the length in the tubing extending between packer 6 and pump 8, thus permitting any slack to be removed from this portion of cable 10. Spacing apparatus 12 can be utilized to elongate the intermediate portion of the tubing string and apply a slight tension to cable 10. The expected operating life of cable 10 will be greater when placed in tension than when slack is allowed. The existence of slack, in the presence of vibration from the operating pump, can result in premature failure of the cable. Elongation of the tubing string utilizing the spacing member, shown in this preferred embodiment of this invention, would generally be accomplished by adjusting the spacing member at the surface of the well prior to insertion of the packer 6 and pump 8. When this adjustment is made the relative positions of packer 6, space-out member 12, and pump 8 on the tubing string 4 would be those to be occupied by downhole operation.

Figure 2:
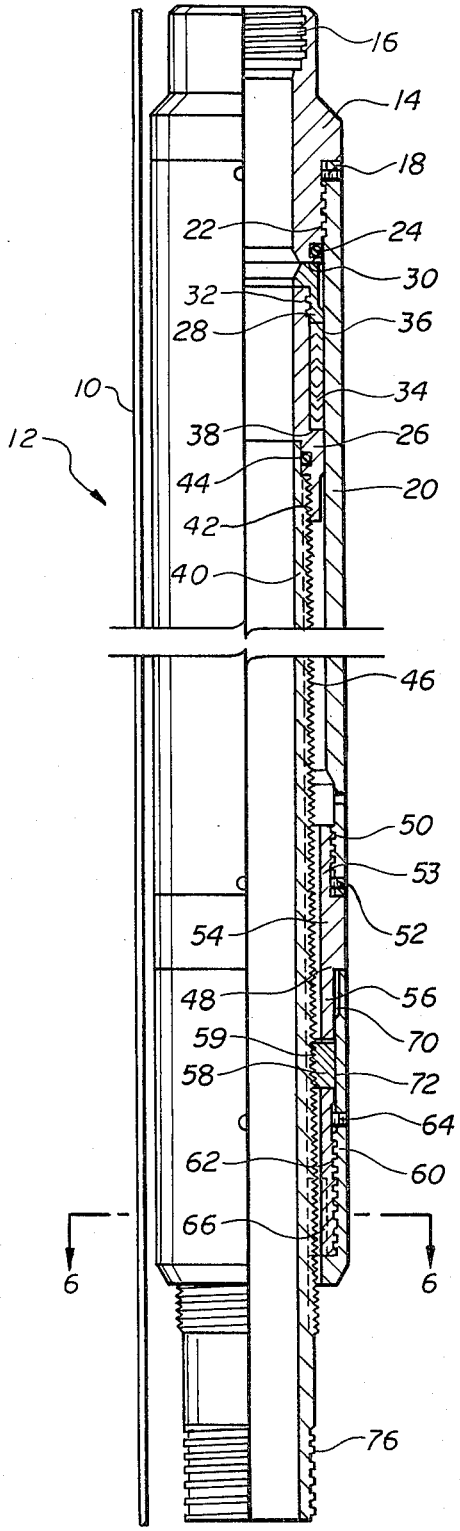
FIG. 2 is a view of the spacing member utilized in this invention showing the components when the spacing member is in the short or retracted position.
Figure 3:
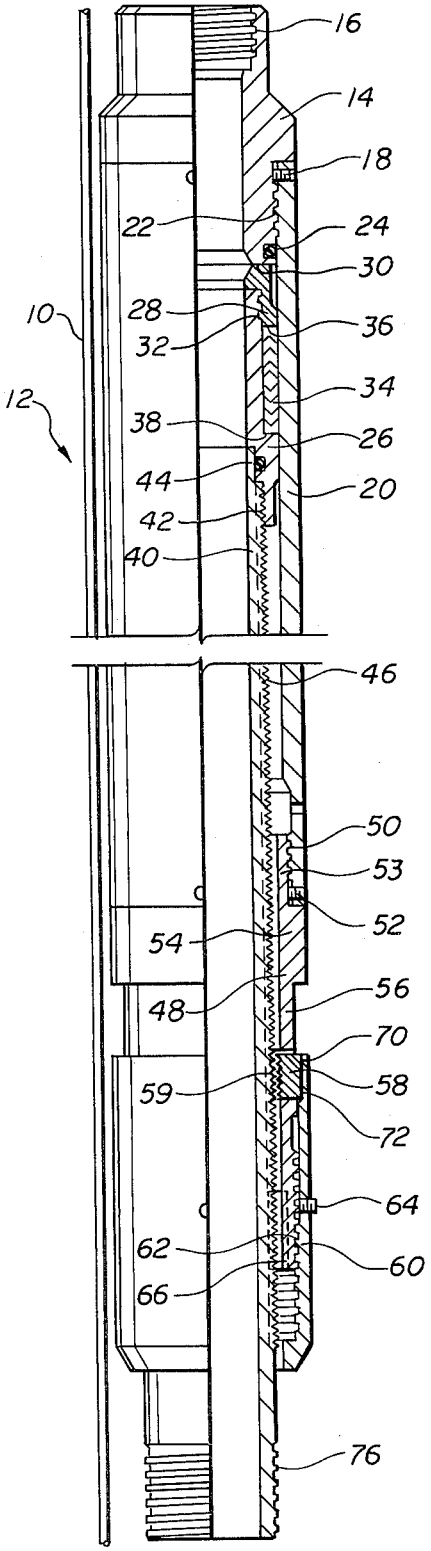
FIG. 3 is a view similar to FIG. 2, but showing the configuration in which the tubing can be elongated without rotation.
Figure 4:
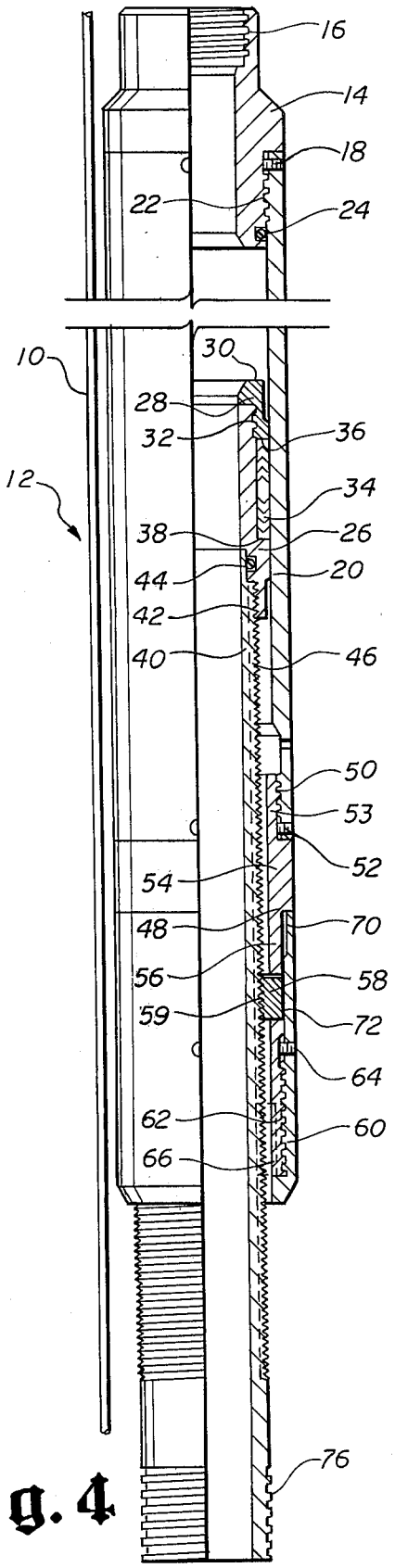
FIG. 4 is a view showing the configuration after elongation.

The spacing member, shown in FIGS. 2, 3 and 4, generally comprises inner and outer telescoping members. An inner body member 40, attached to tubing extending therebelow, can telescope within an outer housing 20, attached to the tubing extending above the spacer member 12. The spacer member 12 is attached to the tubing string 4 at its upper end by means of conventional threads 16 located at the upper end of the top sub member 14. Top sub member 14 is attached to outer housing 20 at its lower end by means of threaded connections 22. A socket screw 18 is positioned to prevent disengagement of threaded connections 22. An O-ring sealing member 24 provides sealing integrity between top sub member 14 and the outer housing 20. Immediately adjacent top sub member 14 and contained within outer housing 20 is a seal retainer 28. In FIG. 2, the upper surface 30 of seal retainer 28 is shown in engagement with the lower surface of top sub member 14. The abutment of these two surfaces establishes one limit for the telescoping movement between body 40 and outer housing 20. Seal retainer 28 has an inner threaded connection 32 with seal mandrel 26. The inner surface of seal mandrel 26 coincides with the inner bore of spacer member 12. Along the outer surface of seal mandrel 26 is a conventional seal stack 34 retained between seal retainer shoulder 36 and seal mandrel shoulder 38. A desirable seal stack for use in this invention is the premium seal stack manufactured by the assignee of this Application and shown on page 672 of the Composite Catalog of Oil Field Equipment and Services for 1980–81, published by World Oil. Other seal stacks may be employed without departing from the scope of this invention. This seal stack 34 provides sealing integrity between the inner surface of housing 20 and seal mandrel 26. Note that the sealing engagement between seals 34 and outer housing 20 will provide sealing integrity when outer housing 20 moves relative to seal mandrel 26 and inner body 40.

Cylindrical body member 40 has external threads along the major portion of its length. These body threads 46 engage cooperating threads on seal mandrel 26 at their upper end. Immediately above body-mandrel threaded connection 42 is an O-ring seal 44 providing sealing integrity between the mandrel 26 and body 40. Outer body threads 46 also provide the means for securing outer housing member 20 to body member 40.

Figure 5:
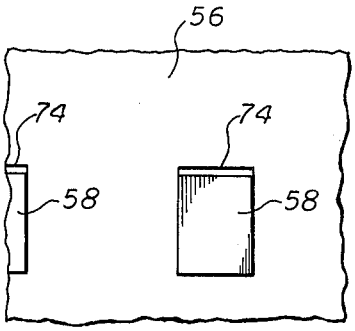
FIG. 5 is a view showing the ratcheting segment members retained in the segment retainer.

The irrotational elongation of spacing member 12 is accomplished at the lower end of body member 40. An adjuster member circumferentially encompassing body member 40 intermediate its ends is attached to outer housing 20 by means of a threaded connection 50. Adjuster member 54 comprises an enlarged central section 48 having an outer diameter generally equivalent to the outer diameter of housing 20 and upper and lower segments having the same internal diameter as section 48, but having a smaller external diameter. Threaded connection 50 is located along the upper threaded section 53 of adjuster 54. A conventional socket screw 52 prevents threaded connection 50 from disengaging. The lower section 56 of adjuster 54 has a plurality of rectangular slots or retaining means 74 extending therethrough, as shown in FIG. 5. In each slot a ratcheting segment 58 is positioned, and the segment cannot move longitudinally relative to adjuster 54. Each ratcheting segment, or internally threaded member, 58 has threds 59 along its inner surface. These threads 59 engage body threads 46 when segments 58 are in the position shown in FIG. 2 and FIG. 4. Segments 58 being retained in slots 74 are longitudinal fixed relative to adjuster member 54 and to the outer telescoping housing 20.

In FIG. 2, segments 58 are retained in engagement with body threads 46 by means of an outer retaining sleeve or segment retainer 60. Segment retainer 60 engages adjuster 54 along lower section 56 by means of a threaded connection 62. A socket set screw 64 prevents disengagement of threaded connection 62. In the position shown in FIGS. 2 and 4, the inner surface 72 of retaining sleeve 60 abuts the outer surface of each segment 58, holding it in engagement with body threads 46.

Figure 6:
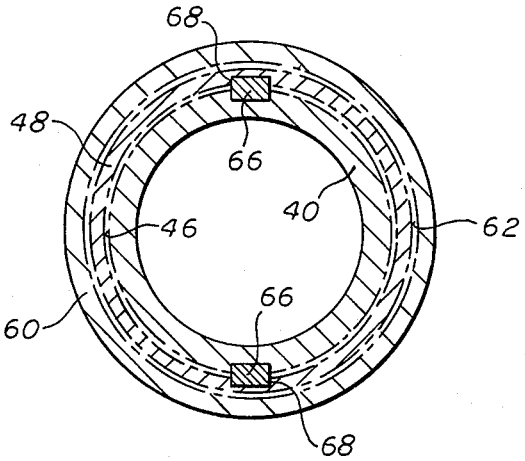
FIG. 6 is a cross-sectional view showing the key which prevents rotation of the various members during elongation.

Rotation between outer housing member 20 and body member 40 is prevented by a plurality of keys 66. Each key is retained within a key slot 68. As shown in FIG. 6, key slot 68 comprises aligned slots extending into the lower section 56 of adjuster 54 as well as into the outer surface of body member 40. At the lower end of body member 40, conventional threads 76 are utilized for engagement with a lower tubing string.

The ratcheting elongation of spacer member 12 is possible when the spacer member is in the configuration shown in FIG. 3. The outer retaining sleeve 60 has been partially disengaged from adjuster 54 as connection 62 has been unthreaded. By partially unthreading sleeve 60 from adjuster 54, the upper section 70 of sleeve 60 has been positioned above segments 58. The upper section 70 of sleeve 60 has a larger internal diameter than the lower section abutting segments 58 in the positions shown in FIGS. 2 and 4. When this enlarged internal diameter is positioned above segments 58, these segments 58 are free to expand radially outward, thus disengaging internal threads 59 from body threads 46. However, the segments are not free to move longitudinally with respect to adjuster 54. Segments 58 can then ratchet along the body threads 46. The sequential elongation of spacer member 12 is shown progressively from FIG. 2 through FIG. 4, with the ratcheting disengagement being accomplished in the configuration shown in FIG. 3. When the spacer member has been elongated to its desired length, sleeve 60 can be fully reengaged with adjuster 54, as shown in FIG. 4. It will be understood that the length of spacer member 12 may be reduced in a similar fashion. It should be noted that in FIG. 4 the components attached to body threads 46 have all been moved longitudinally downwards with respect to outer housing 20. The upper surface 30 of seal retainer 28 no longer engages the lower surface of top sub 14. The telescoping movement of body member 40 relative to outer housing 20 can continue until the lower shoulder on seal mandrel 26 engages the upper shoulder of adjuster 48 adjacent threaded connection 50.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A pumping assembly for use within the casing of a subterranean well, comprising:

an electric submersible pump attached to a lower tubular member;

anchoring means affixing an upper tubular member to said casing;

an electrical cable attached to said electric submersible pump and to said anchoring means;

inner and outer telescoping members between said electric submersible pump and said anchoring means, said telescoping members permitting relative longitudinal movement between said anchoring means and said electric submersible pump;

means for preventing rotation between said inner and outer telescoping members upon relative longitudinal movement therebetween;

first threaded elements extending along the exterior of said inner telescoping member;

at least one segment relatively longitudinally fixed to said outer telescoping member and having second threaded elements on the interior thereof for engaging said first threaded elements; and a longitudinally movable cylindrical sleeve threadably engaging the outer tubular member for movement from a first to a second position and having a stepped inner surface retaining said segment in a radially inward position in threaded engagement with said first threaded elements in said first position, threaded disengagement of said cylindrical sleeve to said second position allowing said segment to expand radially outward to ratchet relative to said first threaded elements during longitudinal movement between said inner and outer telescoping members whereby the spacing between said anchoring means and said electric submersible pump removes slack from said electrical cable extending therebetween, and rotational movement of said cylindrical sleeve to said first position prevents further telescoping movement between said telescoping members.

* * * * *